US008650687B2

(12) United States Patent
Klerer et al.

(10) Patent No.: US 8,650,687 B2
(45) Date of Patent: Feb. 18, 2014

(54) LONG LIFE COMPRESSED CUSHION AND/OR MATTRESS WITH COVER

(75) Inventors: Moshe Klerer, Brooklyn, NY (US); Stuart Simonovits, Brooklyn, NY (US)

(73) Assignee: K2 Health Products, LLC, Brooklyn, NY (US)

( * ) Notice: Subject to any disclaimer, the term of this patent is extended or adjusted under 35 U.S.C. 154(b) by 428 days.

(21) Appl. No.: 12/985,591

(22) Filed: Jan. 6, 2011

(65) Prior Publication Data

US 2011/0162148 A1 Jul. 7, 2011

Related U.S. Application Data

(60) Provisional application No. 61/335,643, filed on Jan. 7, 2010, provisional application No. 61/335,793, filed on Jan. 11, 2010.

(51) Int. Cl.
*A47C 27/14* (2006.01)

(52) U.S. Cl.
USPC ..... 5/740; 5/699; 5/737; 5/738; 53/432; 53/436; 53/524

(58) Field of Classification Search
USPC ..... 5/699, 737, 738, 740, 925; 53/432, 436, 53/524
See application file for complete search history.

(56) References Cited

U.S. PATENT DOCUMENTS

| | | | | |
|---|---|---|---|---|
| 3,521,424 | A * | 7/1970 | Wirfel | 53/419 |
| 3,641,726 | A * | 2/1972 | Cassina | 53/432 |
| 5,007,123 | A | 4/1991 | Salyards | |
| 5,603,284 | A * | 2/1997 | Freedman | 119/28.5 |
| 5,878,551 | A * | 3/1999 | Curley et al. | 53/434 |
| 5,966,976 | A | 10/1999 | Haraga | |
| 6,098,378 | A * | 8/2000 | Wyatt | 53/430 |
| 6,842,921 | B1 | 1/2005 | Tsiarkezos et al. | |
| 6,901,722 | B2 * | 6/2005 | Dextraze et al. | 53/399 |
| 6,952,906 | B2 * | 10/2005 | Nelson | 53/434 |
| 7,374,045 | B2 * | 5/2008 | DiLiberto | 206/524.8 |
| 7,509,700 | B2 * | 3/2009 | Speer et al. | 5/737 |
| 7,698,762 | B2 * | 4/2010 | Hasan et al. | 5/634 |
| 8,347,588 | B2 * | 1/2013 | Oh | 53/429 |
| 2001/0022061 | A1 | 9/2001 | Resta | |
| 2007/0204566 | A1 * | 9/2007 | Lee | 53/430 |

OTHER PUBLICATIONS

Nellcs, Keeping Mattresses Clean & Costs Down, Packaging Machinery, Bags & Films Critical to Delivery, BedTimes, Product Watch, Mar. 2009, http://www.bedtimesmagazine.com/Articles/2009/March/KeepingMattressesCleanAndCostsDown.html.

* cited by examiner

*Primary Examiner* — Michael Trettel
(74) *Attorney, Agent, or Firm* — Kenyon & Kenyon LLP

(57) ABSTRACT

A method for reducing a cushion footprint for long-term storage may include inserting a foam core into a plastic cover, subsequently applying a vacuum to the plastic cover, and, while under the vacuum effect, sealing the plastic cover, and its contents. A device providing the vacuum effect may include a surface having protruding sections connected to non-protruding sections via tapered sections. A cushion may include an at least 20 density high resiliency foam core, and a fabric cover that includes (a) a combination of polyester and spandex and/or lycra, (b) nylon to which a thin water resistant material coating is applied, and/or (c) polyester fabric including raised anti-slip polyvinyl chloride dots, other portions of the polyester fabric at which the dots are not positioned having applied thereto a polyvinyl chloride coating. The device may compress the foam core while housed in a fabric cover, housed in the plastic cover.

36 Claims, 4 Drawing Sheets

LONG LIFE COMPRESSED CUSHION AND/OR MATTRESS WITH COVER

CROSS-REFERENCE TO RELATED APPLICATIONS

This application claims the benefit, under 35 U.S.C. §119(e), of U.S. Provisional Patent Application No. 61/335,643, filed Jan. 7, 2010, and of U.S. Provisional Patent Application No. 61/335,793, filed Jan. 11, 2010, the entire contents of each of which is hereby incorporated by reference.

FIELD OF THE INVENTION

The present invention relates to a system and method for providing cushions and/or mattresses in a compressed state for an extended period of time, and to a cushion and/or mattress arrangement by which the cushion and/or mattress may be stored long-term in a compressed state.

BACKGROUND

Shipping and storing of cushions and mattresses are often difficult, expensive, and require large spaces due to their large size. Many such cushions and mattresses sold in the marketplace include a foam core with a fabric case that covers the foam core and is designed to be used in conjunction with the foam core. The cover is used to protect the foam core, make the product more attractive, allow for easy cleaning, and for comfort.

For the mattress to be used as a medical mattress, e.g., for use in a nursing home, hospital, or patient-home-care setting, such that a patient who purchases the mattress and is covered by a Medicare plan may be reimbursed for the purchase, the Medicare system requires the product to contain a water resistant cover, presumably to prevent fluids soaking the foam core.

Medical mattress covers typically have a vinyl slip resistant surface on at least one side of the cover, particularly at the bottom surface of the mattress opposite the surface on which the patient lies when the mattress is used, which non-slip surface may avoid slippage of the mattress with respect to a bed-frame on which the mattress lies.

SUMMARY

The present invention is directed to cushions and/or mattresses configured for long-term compression, thereby allowing for their storage and shipment with a small footprint, reducing cost and maximizing efficiency of such storage and/or shipment. The present invention is also directed to a method of compressing, storing, and/or decompressing cushions and/or mattresses in a manner that provides for their storage and/or shipment with a small footprint. The present invention is also directed to an apparatus and/or system for compressing cushions and/or mattresses in a manner that provides for their storage and/or shipment with a small footprint.

In particular, the noted mattresses and/or cushions may be suitable as medical mattresses and may meet requirements of the Medicare system, such as those described above.

An example method, according to the present invention, for providing a cushion in condition for storage includes: inserting a foam core into a plastic cover; subsequent to the insertion of the fabric covered foam core into the plastic cover, applying a vacuum to the plastic cover; and, while the plastic cover is under the vacuum effect, sealing the plastic cover, and its contents.

In an example, the method may further include: inserting the foam core into a fabric cover prior to the insertion of the foam core into the plastic cover, the step of inserting the foam core into the plastic cover including inserting the foam core with its fabric cover into the plastic cover.

The method may further include: folding and/or rolling the sealed plastic covered, fabric covered, foam core into a small footprint object having a shape.

The method may further include (a) preserving the shape by at least one of taping and sealing the footprint object, and/or (b) inserting the small footprint object into an outer sleeve.

The method may further include inserting the small footprint object into an outer cover that has a zipper, and constraining the small footprint object within the outer cover by zippering the zipper.

The outer cover may be formed of a non-woven material of fibers bonded together by at least one of chemical treatment, mechanical treatment, heat treatment, and solvent treatment.

The method may further include applying an adhesive to the small footprint object to preserve the shape, wherein the adhesive includes non-stick tabs at an outer-exposed edge of the adhesive.

The method may further include inserting the small footprint object into an outer sleeve that includes a pre-cut perforation.

The method may further include inserting the small footprint object into an outer sleeve, and subsequently puncturing holes into the plastic cover while the small footprint object is contained in the outer sleeve.

The fabric cover may include a cloth made by at least one of weaving, knitting, and felting fibers.

The plastic cover may include a polyethylene material.

The plastic cover may include four edges. Prior to the step of inserting the fabric covered foam core into the plastic cover, three of the edges may be sealed and the fourth edge may remain unsealed for the insertion of the fabric covered foam core into the plastic cover via the unsealed fourth edge, and the sealing step may include sealing the fourth edge.

The applying of the vacuum may include compressing the combination of the foam core, fabric cover, and plastic cover.

A top side of the combination and an opposite bottom side of the combination may be pressed towards each other by the compressing step.

During the compressing step, the bottom side may remain stationary while the top side is pressed towards the bottom side.

The compression may be performed by a movable surface of a compression machine pressing down on the top side.

The movement of the movable surface may be implemented mechanically, hydraulically, and/or electrically.

In an example, at least one edge of the movable surface includes at least a part of a heat sealing apparatus via which the sealing step is performed.

The compressing step may include applying a compressive force of approximately 2,624,790 Pa to the combination.

In an example, in the compressing step, at least one outer edge of the foam core is compressed to a lesser degree than at least one inner portion of the foam core. For example, a compressing apparatus presses against the foam core for performing the compressing, the compressing apparatus including a block that includes a thin portion by which the at least one outer edge is compressed, a thick portion by which the at least one inner portion of the foam core is compressed, and a tapered portion by which the thick and thin portions are connected.

In an example embodiment, in the compressing step, at least one outer edge of the foam core and a center of the foam core are compressed to a lesser degree than at least one inner portion of the foam core that lies between the center and the at least one outer edge.

An example cushion arrangement according to an example embodiment of the present invention includes: an at least 20 density high resiliency foam core; and a fabric cover, where the fabric cover includes: (a) a combination of polyester and at least one of spandex and lycra; (b) nylon to which a thin water resistant material coating is applied; and/or (c) a polyester fabric including raised anti-slip polyvinyl chloride dots, other portions of the polyester fabric at which the dots are not positioned having applied thereto a polyvinyl chloride coating.

In an example, the foam core includes at least one of an ethylene based foam and a urethane based foam.

In an example, the fabric cover includes the nylon to which the coating is applied, the coating including a polyvinyl chloride material.

In an example embodiment, at least one side of the fabric cover includes a slip resistant vinyl material, and (a) the slip resistant vinyl material includes holes plugged by a waterproof material and/or (b) the slip resistant vinyl material overlays a waterproof material.

An example cushion arrangement according to an example embodiment of the present invention includes: a foam core; a plastic cover; a fabric cover housed by the plastic cover and housing the foam core; and an outer cover housing the plastic cover while the plastic cover houses the fabric cover and the fabric cover houses the foam core. The foam core may be compressed while maintained in the plastic and fabric covers.

In an example, the plastic cover is heat sealed while housing the fabric cover and foam core.

In an example, the plastic cover is initially heat sealed while housing the compressed foam core, prior to insertion into the outer cover, and unsealed while maintained in the outer cover.

An example compressing device, according to an example embodiment of the present invention, includes two surfaces configured for relative movement towards and away from each other. In an example, at least one of the surfaces includes at least one protruding section and at least one non-protruding section, each of the at least one protruding section being connected to at least one respective one of the at least one non-protruding section by a respective tapered section.

In an example, at least one edge of at least one surface includes at least a part of a heat sealing apparatus.

DETAILED DESCRIPTION

Example embodiments of the present invention provide a system and method which allow for compression of a cushion and/or mattress, such that the cushion and/or mattress is in a compressed state for an extended period of time, which may allow for the cushion and/or mattress to be shipped, stored, and sold in the compressed state. Further, example embodiments of the present invention provide a system and method in which the cushion and/or mattress may be fully assembled prior to said compression, so the product is ready for use by the consumer upon decompression, e.g., after purchase, with no other modifications. For example, the cushion and/or mattress would not have to be fit with a cover or positioning strap or other product parts after decompression.

The inventors have discovered that there are many advantages to having a cushion and/or mattress that can be shipped, stored, and sold in a compressed state in which it remains for an extended period of time, and/or to fully assembling the cushion and/or mattress prior to such compression.

Some of these advantages include the following: more economical shipping and delivery; "greener" transportation by increasing units per truck/container load; greener packaging; and economical storage. For example, the compression proposed by the present invention helps retailers maximize precious shelf space in order to sell maximum amount of products per square inch of shelf. Medical equipment companies, similarly, may make deliveries with smaller vehicles. Further, the product is more easily stored by "stacking" the product. "Greener packaging" is provided because the compressed product requires less packaging materiel than if in an uncompressed form. Because of its small size, the product might not be classified as "over-size" by national carriers, so that shipping via national carriers may be at a cheaper rate.

To realize all these benefits, example embodiments of the present invention provide for the cushion and/or mattress product to remain in a compressed state for an extended period of time, and yet still regain its pre-compression properties after its decompression. In this regard, embodiments of the present invention provide said compression and materials for the cushion and/or mattress in a manner that allows the product to retain its viability and good condition from compression of the foam in the factory to a desired compressed size, which compression partially breaks down some of the internal structure of the foam, to its ultimate decompression, e.g., by the consumer, and finally for an extended subsequent period of use post-decompression.

Figure 1:
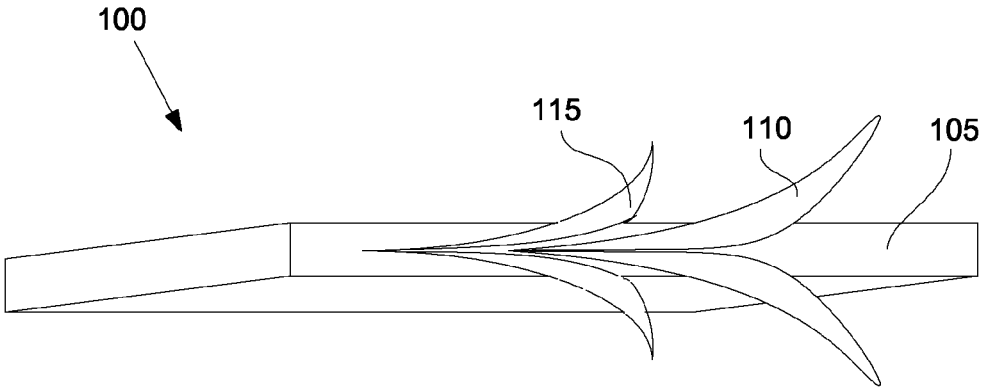
FIG. 1 shows an exploded view of a cushion/mattress according to an example embodiment of the present invention.

As noted above, and referring to FIG. 1, cushions and mattresses 100 often include a foam core 105 with a fabric case 110 (shown in exploded form in FIG. 1) that covers the foam core 105 and is designed to be used in conjunction with the foam core 105. The fabric case 110 is used to protect the foam core, make the product more attractive, allow for easy cleaning, and for comfort. It is advantageous to have such a case 110 already encasing the foam core 105 at the time of purchase, as consumers may find it awkward or difficult to encase the foam core 105 with the case 110 after purchase.

In order for the product to be able to maintain its form and other specifications after prolonged compression, example embodiments of the present invention provide for use of a particular foam as the foam core 105 of the cushion and/or mattress 100. In an example embodiment, a 20 density (or higher) high resiliency (also referred to as high-rebound) foam is used, where the density measurement refers to the number of pounds the foam weighs per cubic foot. The foam may be any ethylene and/or urethane based foam, e.g., a polyethylene or polyurethane foam. Such foam is soft enough to be significantly compressed, while being resilient enough to decompress to a high percentage of its original pre-compression size after many months of being in its compressed state.

In an example embodiment, the foam-based cushion and/or mattress product 100 is compressed with its case 110 already placed on the foam core 105, and the materials used for the case are tailored to allow for maintaining such encasement with the case 110 during compression. In an example embodiment, the case is made from a "breathable" fabric, which allows for proper air flow for a compression and a vacuum effect created for the foam core 105, and which is wrinkle resistant to avoid wrinkles and creases to the fabric case 110 which may be caused by the compression. The compressive state may be maintained despite the use of breathable material, by a plastic film or bag 115 which is heat-sealed, as described below. Accordingly, in an example embodiment of the present invention, a wrinkle resistant yet breathable fabric, e.g., a combination textile material of polyester and spandex or Lycra, is used for the case 110. For example, a Poly-Lycra blend may be used as the wrinkle resistant and breathable foam core case 110.

For the mattress 100 to be used as a medical mattress, e.g., for use in a nursing home, hospital, or patient-home-care setting, example embodiments provide materials which allow for the mattress to be coded for the Medicare system, such that a patient who purchases the mattress and is covered by a Medicare plan may be reimbursed for the purchase. Currently, in order to be coded for reimbursement, the Medicare system requires the product to contain a water resistant cover, presumably to prevent fluids soaking the foam core. Accordingly, an example embodiment of the present invention provides for the cushion and/or mattress case 110 to be water resistant. Use of the water resistant material creates a challenge to performing the compression and the decompression with the case 110 already on the mattress 100 as compression may include air flow out from the foam core 105 in one or more, and preferably all, directions, and, similarly, decompression may include air flow into the foam core 105, while most water resistant materials do not allow for significant, if any, air flow.

Figure 2:
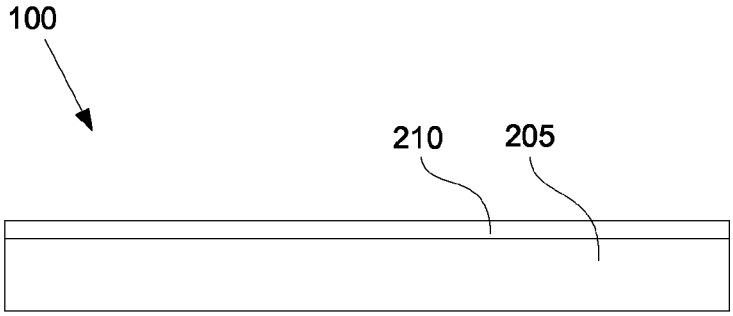
FIG. 2 illustrates layers of a breathable fabric case for a foam core treated for water-proofing, according to an example embodiment of the present invention.

Accordingly, in an example embodiment, in order to achieve proper compression and decompression for the cushion and/or mattress product 100 when the case 110 is already covering the foam core 105, a water resistant, yet air permeable material is used, as the case 110. Referring to FIG. 2, to obtain such a material, in an example embodiment of the present invention, a method, according to an example embodiment of the present invention, may include applying a, for example thin, water resistant material coating 210, e.g., a polyvinyl chloride (PVC) material, to a breathable fabric 205, such as nylon. For example, such a fabric 205 may be used instead of the example polyester and spandex or Lycra blend described above.

Medical mattress covers typically have a vinyl slip resistant surface on at least one side of the cover, particularly at the bottom surface of the mattress opposite the surface on which the patient lies when the mattress is used, which non-slip surface may avoid slippage of the mattress with respect to a bed-frame on which the mattress lies. Such a vinyl slip resistant surface, for example, which is more slip-resistant than a breathable fabric treated with a thin water resistant coating, may inhibit air flow, which may be less than optimal even if the non-slip material is used at only one side of the cover.

Figure 3:
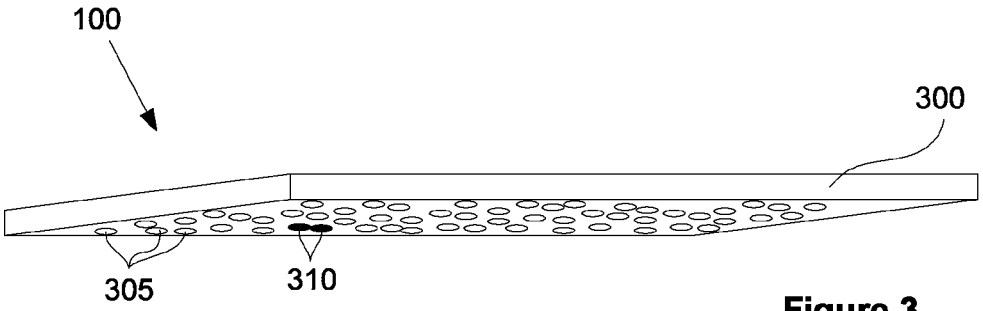
FIG. 3 illustrates a slip-resistant cover for a foam core, according to an example embodiment of the present invention.

Accordingly, referring to FIG. 3, in an example embodiment of the present invention, a, for example, non-breathable, slip-resistant vinyl material 300 may be used for the case 110 on at least one side of the mattress 100, and the method may include puncturing the material 110 to produce holes 305 for "breathing" in various places, enabling air flow for the compression. The puncturing may be performed before or after, but preferably before, placement of the foam core 105 in the slip-resistant material 300. A breathable material treated with waterproofing 310, e.g., a PVC treated material, may be applied at the puncture sites 305 to maintain the waterproofing of the side(s) in which the slip-resistant vinyl material 300 is used. Alternatively, the slip-resistant vinyl material 300 may overlay the water-resistant material, so that water-proofing of the slip-resistant material may be omitted. For example, the method may include placing the foam core 105 into the water-resistant, breathable material cover 205/210, and sewing or otherwise attaching the slip-resistant material 300 onto at least one side of the cover 205/210. The attachment of the slip resistant material 300 may be performed before or after, but preferably before, the placement of the foam core 105 into the water-resistant, material cover 205/210.

Figure 4:
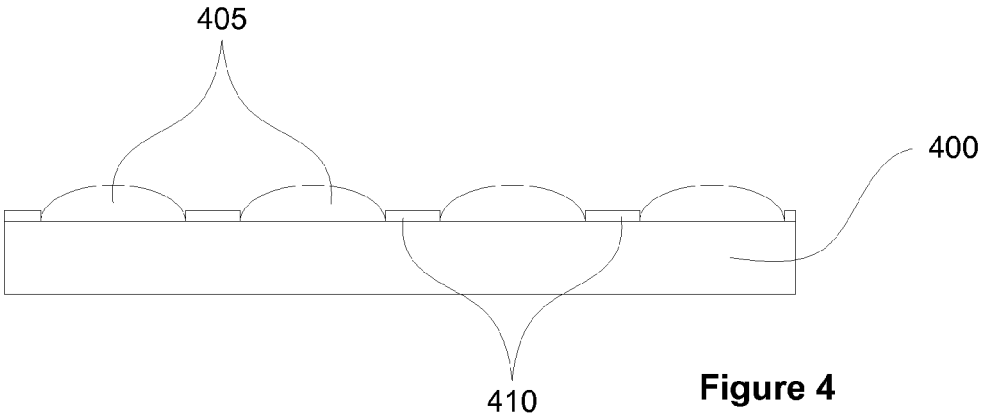
FIG. 4 illustrates a cover with raised polyvinyl chloride (PVC) dots, according to an example embodiment of the present invention.

Alternatively, referring to FIG. 4, a 100% polyester fabric 400 (which is breathable) with raised PVC dots 405, for traction and non-slip properties, may be used, and the portions of the fabric which do not include the PVC dots 405 may be treated with water resistant processing by applying a, for example thin, PVC coating material 410 to the polyester fabric 400. The non-slip properties of the raised PVC dots 405 may be greater than the PVC coating 410. In an example embodiment, the material having the non-slip properties may be limited to one side of the cover 110, e.g., intended to be opposite the side on which a person lies when the product is in use, to prevent the cushion and/or mattress 105 from sliding on a bed on which it is placed. For example the water-proof treated nylon material may be used at the other sides/edges of the mattress.

In an example embodiment, a slip-resistant material as described above may be used, whether waterproofed or not, on one side of a cushion, the other sides having the wrinkle-resistant yet breathable fabric described above. For example, the other sides may have the described combination textile material of polyester and spandex or Lycra, e.g., a Poly-Lycra blend.

Figure 5:
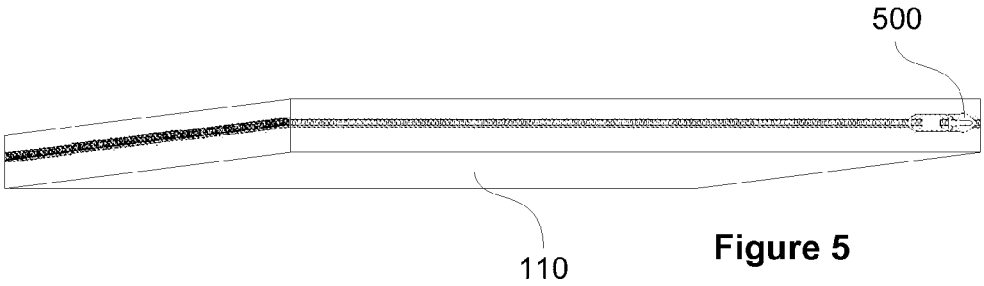
FIG. 5 shows a cover for a foam core, having a zipper for breathability, according to an example embodiment of the present invention.

Referring to FIG. 5, in an example embodiment of the present invention, an essentially non-breathable, but water-resistant material, e.g., a PVC material, may be used for the cover 110 of the foam core 105. The cover 110 may further include a zipper 500. The zipper 500 may be breathable, thereby allowing compression and decompression. Since the cover 110 mostly includes water-resistant material, the foam core 105, covered with the described cover 110 would be reimbursable under the Medicare system even with the zipper 500. In an example embodiment, the zipper 500 may be large enough, and positioned such that, the cover 110 may be thereby opened for placing the foam core 105 into the opened cover 110 and such that that cover 110 may be subsequently closed to completely encase the foam core 105, as shown in FIG. 5. For example, the cover 110 may form-fit the foam core 105, and the zipper 500 may extend across an entire length of at least one side of the cover 110, and preferably at least three adjacent sides of the cover 110. In an example embodiment, the cover 110 may further include a flap (not shown) made of water-proof material, which may extend over the zipper 500 (without sealing the zipper 500), for additional water-proofing. For example, the flap may extend from the non-breathable material at one side of the zipper 500, immediately adjacent the zipper 500. Alternatively, two flaps may be included, a first one extending from the non-breathable material at a first side of the zipper 500 and a second one extending from the non-breathable material at a second side of the zipper 500. The two flaps may partially or completely overlap, or external edges thereof may meet without an overlap.

In an alternative example embodiment, instead of a zipper 500, a breathable material, e.g., a strip of breathable material, may be used to separate the portions of the cover 110 having non-breathable material. For example, the breathable material may be positioned where the zipper 500 would be positioned in the cover 110 shown in FIG. 5 after the cover 110 is closed. In an example embodiment, the cover 110 may further include a flap made of water-proof material, which may extend over the breathable material (without sealing the breathable material), for additional water-proofing. For example, the flap may extend from the non-breathable material at one side of the breathable material, immediately adjacent the breathable material. Alternatively, two flaps may be included, a first one extending from the non-breathable material at a first side of the breathable material and a second one extending from the non-breathable material at a second side of the breathable material. The two flaps may partially or completely overlap, or external edges thereof may meet without an overlap.

Figure 6:
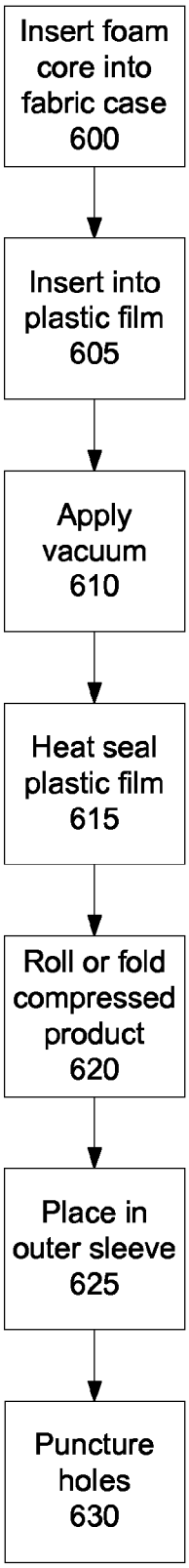
FIG. 6 is a flowchart of a method for reducing a footprint of a cushion/mattress, according to an example embodiment of the present invention.

Referring to FIG. 6, according to an example embodiment, a method includes, at step 600, inserting a foam core into a fabric cover, for example, as described above, and subsequently, at step 605, placing the covered foam core into a plastic film or bag. In an example embodiment, the plastic bag is a polyethylene (PE) bag. The method may further include sealing the bag on three sides, with the bag being left with an opening at a fourth side into which the covered foam core may be inserted in the placing step.

Figure 7:
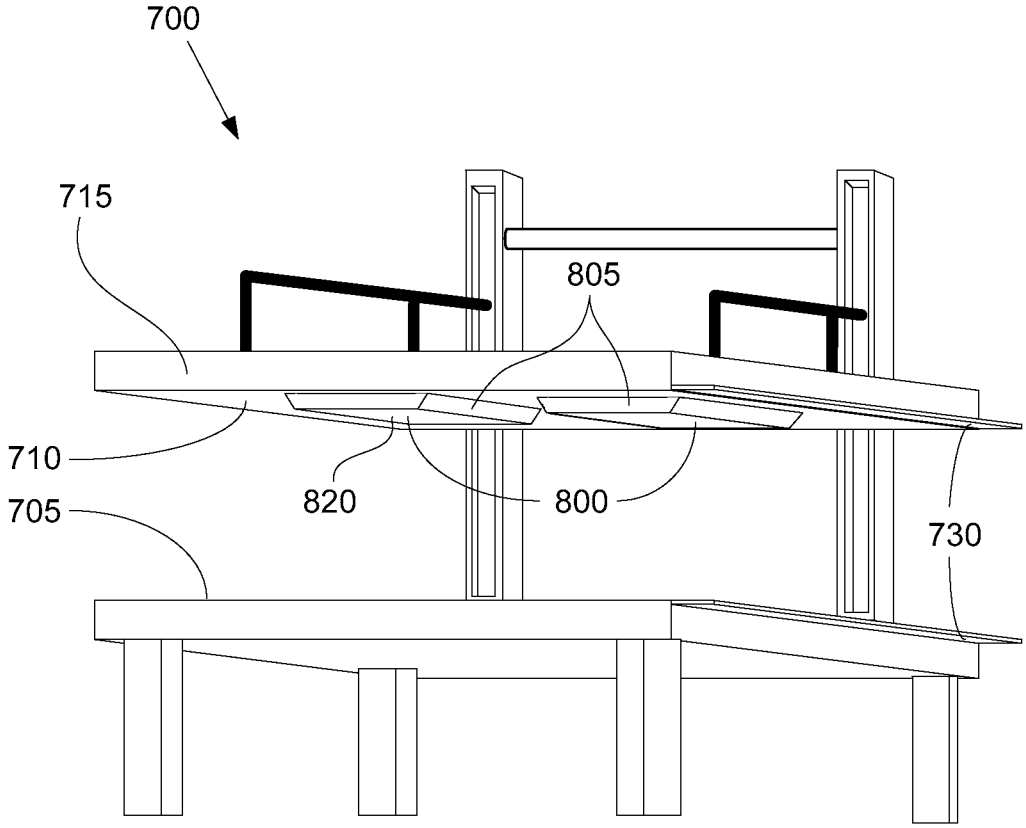
FIG. 7 shows a compression machine, according to an example embodiment of the present invention.

The method may further include, at step 610, applying vacuum to the covered foam core after it has been inserted into the plastic bag. In an example embodiment, the vacuum may be applied via vertical compression processing. For example, a compression machine 700, e.g., as shown in FIG. 7, may be used for pressing a top side of the covered foam core toward an opposite bottom side of the covered foam core, while the covered foam core is in the plastic bag. In an example embodiment of the present invention, the machine 700 may apply to the covered foam product a compressive force of 2,624,790 Pa or approximately 2,624,790 Pa. For example, if the product measures 0.1905 meters (7.5")×0.3556 meters (14"), for a total force area of 0.0677418 meters squared, 177,808 N of force may be applied for the compression. In an example embodiment, the entire cushion and/or mattress may be placed on a stationary surface 705 of the compression machine and may be beneath a surface 710 of a movable pressing board 715 of the compression machine 700. While the cushion and/or mattress is so positioned, the movable surface may be mechanically, hydraulically, and/or electrically moved downwards towards the cushion and/or mattress.

The inventors have discovered that it may occur that a center region of the cushion/mattress decompresses at a faster rate than the edges of the cushion/mattress, and may even occur that the edges never decompress to the same extent as do other portions of the cushion/mattress. For example the center region may decompress to 6 inches while the edges may only decompress to 5.6 inches.

The inventors have also discovered that it may be desirable for certain parts of the cushion/mattress, e.g., a mid-section that usually would bear the bulk of a person's weight, to be more firm than other parts of the cushion/mattress. This may be very beneficial for medical cushions or mattresses where pressure prevention with different firmness zones on a cushion or mattress is desirable.

Figure 8:
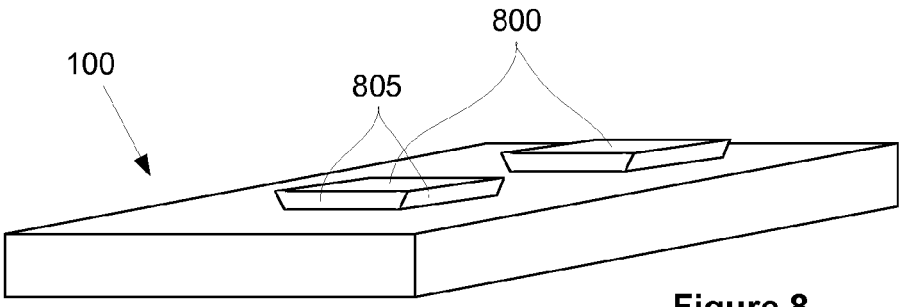
FIG. 8 shows a cushion/mattress with blocks for a staged compression, according to an example embodiment of the present invention.

Therefore, according to an example embodiment of the present invention, a staged compression may be performed, whereby the edges and/or other predetermined parts, e.g., the mid-section, of the cushion/mattress may be compressed to lesser degree that other parts of the cushion/mattress. In an example embodiment, the staged compression may include placing blocks of a hard substance, such as wood, metal, or extremely dense foam, on those parts of the cushion/mattress that are to be more compactly compressed, e.g., those parts other than the edges and/or the center of the cushion/mattress, prior to compression by the compression machine. For example, FIG. 8 shows a mattress 100 including blocks 800 placed thereon. When a smooth surface (not shown in FIG. 7) of the compression machine 700 is shifted downwards towards the top surface of the mattress 100 upon which the blocks 800 lie, the portions of the mattress 100 beneath the blocks 800 will be more compactly compressed than the remaining portions of the mattress 100.

Alternatively, as shown in FIG. 7, the bottom surface 710 of the movable pressing board 715 of the compression machine 700 may have attached thereto or have formed integral thereon blocks 800. When the movable pressing board 715 is shifted downwards upon the top surface of the cushion/mattress 100, those portions of the cushion/mattress 100 which are positioned under the blocks 800 will be more compactly compressed than the remaining portions of the cushion/mattress 100. The blocks 800 may be positioned at a distance from the external edges of the pressing board 715 and away from the center of the pressing board 715 as shown in FIG. 7. In an example embodiment of the present invention, the compression machine 700 may be configured such that the blocks 800 are movable along the surface of the pressing board 715, in order to optimally position the blocks 800 for different sized cushions/mattresses. For example, the bottom surface 710 of the movable pressing board 715 may include tracks along which the blocks 800 may be shifted. Alternatively, the bottom surface 710 of the movable pressing board 715 may include notches into which pegs attached to the blocks 800 may be inserted.

If the edges of the blocks 800 are straight such that they extend perpendicular to the top surface of the cushion/mattress 100, the differences in the compression stages may be noticeable on the finished product. Accordingly, in an example embodiment of the present invention, the blocks 800 may have tapered edges 805 extending from the bottom surface 710 of the pressing board 715 to a bottom surface 820 of the blocks 800 that face and are parallel to a top surface of the cushion/mattress 100 that is placed on the surface 705 of the bottom section of the compression machine 700. The differences in the compression stages may thereby be more gradual and less noticeable. The blocks 800 placed on the top surface of the mattress 100 shown in FIG. 8 may similarly include tapered edges 805. For example, a block 800 may be 3 inches thick at its center and may gradually taper at its edges to 1 inch thick or less. The blocks may arranged such that the tapered edges 805 of each of the blocks 800 taper outwards from a surface of the respective block 800 facing a surface of the cushion/mattress 100 to an opposite surface of the respective block 800 facing away from the surface of the cushion/mattress 100, such that the surface of the blocks 800 facing the surface of the cushion/mattress 100 have less surface area than the oppositely facing surfaces of the blocks 800.

Referring again to FIG. 6, the method may further include, at step 615, heat-sealing the open end of the plastic film while the covered foam core, which is inserted in the plastic film, is still compressed and under the vacuum effect, thereby ensuring that the plastic film/bag is air-tight. For example, the compression machine may include a heat sealer 730 at at least one end of the machine, as shown in FIG. 7.

In an example embodiment of the present invention, the method further includes, at step 620, rolling the compressed covered foam core into a tubular shape, or otherwise folding the compressed covered foam core, which may make the covered foam core more manageable for storage, shipping, and sale. In order to keep the product in this tubular shape, or other folded or rolled state, the product may be taped, sealed, and/or, at step 625, placed in an additional outer plastic bag or sleeve, as is typically done for compressed cushions without long-life compression.

Leaving the cushion/mattress in the rolled state over a long period of time contributes to wrinkles on both the outer fabric covering and the inner foam core. However, the portion of the cushion/mattress that is facing inside of the roll will be much more wrinkled than the portion of the cushion/mattress facing the outside of the rolling, because the portion on the outside of the rolling is stretched by the rolling action. Therefore, according to an example embodiment of the present invention, where different materials are used for the side of the cushion/mattress upon which one is intended to lie and the opposite side, e.g., where the opposite side includes the non-stick material, the rolling may be performed such that the top portion of the cushion/mattress on which it is intended for the consumer to sit or lie is positioned on the exterior with respect to the direction of the rolling.

Figure 9:
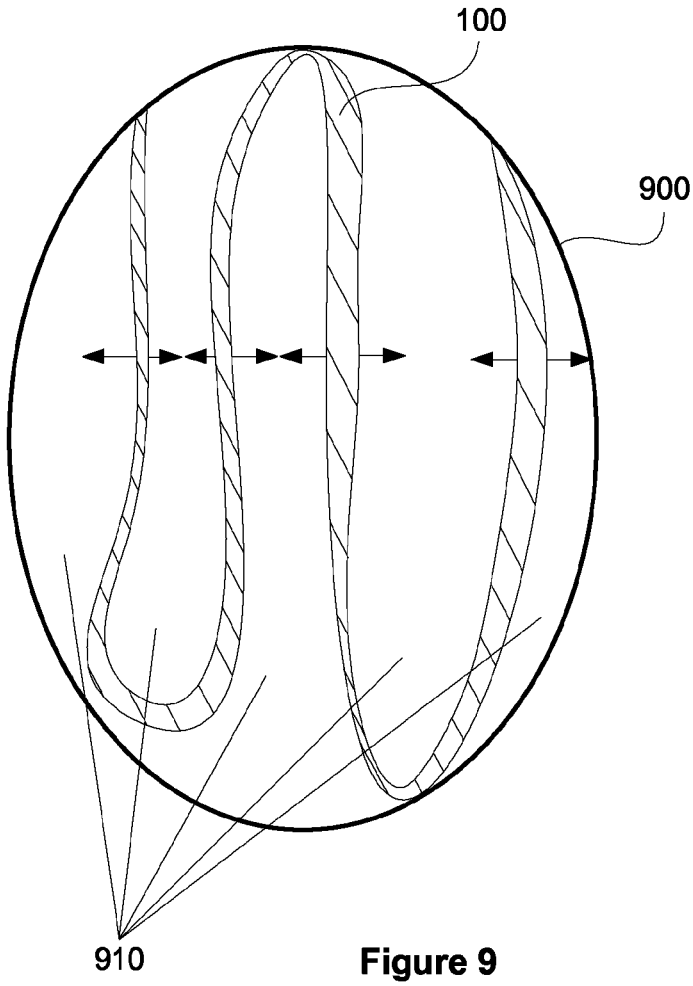
FIG. 9 shows a compressed cushion/mattress within a tubular outer sleeve, according to an example embodiment of the present invention.

In an example embodiment of the present invention, the method may further include, at step 630, after insertion into the additional outer sleeve, puncturing holes in the heat sealed plastic film. The cushion may then slightly decompress due to the passage of air through the holes, to the extent allowed by the space limitations of the interior of the additional outer sleeve. The decompression causes the cushion and plastic cover to fill in extra space within the outer sleeve. For example, FIG. 9 shows an outer sleeve 900 housing the cushion 100, with spaces 910 between portions of the cushion 100. The cushion decompression within the outer sleeve 900 may cause the cushion 100 to expand, for example, in the direction of the illustrated arrows (and in other directions), filling in some or all of the spaces 910. For example, if a 6 inch thick foam product is compressed down to 2 inches and rolled into the outer sleeve 900 leaving extra space 910 within the outer sleeve 900, the foam product may subsequently slightly decompress and expand, e.g., to 3 inches, when the holes are punctured into the plastic film. The outer sleeve 900 may be open at an end, e.g., as shown in FIG. 9. The puncturing of the holes may be performed via the opening. Alternatively, the outer sleeve 900 may be closed at all sides and the outer sleeve 900 and the heat sealed plastic film may both be punctured.

The puncturing of the holes allowing passage of air through the foam core may extend the life of the ability of the foam core to decompress. Otherwise, if the foam core remains sealed in the airtight inner plastic film over a prolonged time span, the firmness and rebound capabilities of the foam core may be negatively affected. Additionally, the nature of foam is such that generally the more foam is compressed the longer it will take for the foam to rebound. The decompression allowed by the puncturing of the holes in the plastic film may therefore cause the cushion to later fully decompress at a quicker rate.

Because the covered foam core is in a compressed state and/or because of the covered foam core's rolled state, the outer plastic sleeve or tape may be under tremendous pressure, due to a natural tendency of the foam to exert forces in a decompression direction and/or to unroll, and push heavily against the plastic sleeve. Because of such pressure, manual opening of the outer sleeve or tape, without an instrument, may be difficult, which may lead to the use, e.g., by the consumer/customer or delivery personnel, of a sharp object to cut open the plastic sleeve, which may result in damage to the product, e.g., cutting of the cover, for example, the polyester, vinyl, and/or Poly-Lycra blend of the cover, which cover is to remain over the cushion and/or product during its use. (For cushions and/or mattresses compressed without a cover and which are covered after decompression, this is not as great a concern since, even if the sharp object pierces the product, only the foam core, and not its subsequently placed cover, would be pierced. However, particularly in an instance where the mattress/cushion is compressed with a cover, the sharp object may pierce the fabric cover, resulting in an unacceptable gash.)

In order to overcome this challenge, in an example embodiment of the present invention, the outer sleeve is designed such that is does not require (nor prompt) the usage of a sharp object for the removal of the sleeve. For example, an embodiment provides for use of an outer sleeve with a zipper, so the user only has to unzip the outer sleeve for its removal. As a zipper might not work optimally when incorporated in a plastic, the outer sleeve may instead be made from non-woven fabric, for example, a fabric-like material including fibers bonded together by chemical, mechanical, heat, or solvent treatment.

Especially for a large cushion and/or mattress, whose size would require a large amount of material for the outer sleeve, the non-woven fabric might not be an economical choice for the outer sleeve. Therefore, an example embodiment provides for elimination of the outer sleeve and use of tape to roll the compressed mattress into the tubular shape. In order to eliminate piercing with a sharp object, the example embodiment provides non-stick tabs at an outer edge of each strip of tape, allowing for easy removal of the tape by pulling at the tabs, eliminating the need for any sharp object.

Alternatively, one or more Velcro or other straps may be used instead of or around the outer sleeve, the Velcro or other strap being wound about a circumference of the tube formed by the rolled covered foam core.

In an example embodiment, buckles and/or hooks may be used for straps about the folded or rolled covered foam core. For example a buckle(s) and/or hook(s) may be used to connect to ends of straps, and maybe easily unfastened.

Alternatively, a plastic sleeve with a pre-cut perforation is used as the outer sleeve, which perforation may be used to easily split open the outer sleeve without use of a sharp object. For example, the outer sleeve housing the covered foam core may form a tubular shape and the pre-cut perforation may extend along the entire length or approximately the entire length of the tube.

Alternatively, the compressed covered foam core may be rolled (or otherwise folded) into the tubular shape and then inserted into a box, e.g., without an outer sleeve, the box being of such structural soundness that it withstands the pressure of the compressed foam trying to "unroll" from its tubular form.

For using the product after it has been placed in its compressed and covered state and in the outer sleeve, box, tape, and/or straps, a person may remove the compressed covered foam core from the outer sleeve, box, tape, and/or straps, and then un-roll (or otherwise unfold) the compressed covered foam core from its tubular shape (to the extent natural forces have not already done so). The inner airtight plastic bag, which had been previously hot-sealed, may be opened causing air to flow through the vapor permeable cover, thereby exposing the foam core to the air, which may cause decompression. The high resiliency foam core may then recover its original characteristics and return to its original size or nearly its originally size, prior to the compression.

The above description is intended to be illustrative, and not restrictive. Those skilled in the art can appreciate from the foregoing description that the present invention may be implemented in a variety of forms, and that the various embodiments may be implemented alone or in combination. Therefore, while the embodiments of the present invention have been described in connection with particular examples thereof, the true scope of the embodiments and/or methods of the present invention should not be so limited since other modifications will become apparent to the skilled practitioner upon a study of the drawings, specification, and following claims.

What is claimed is:

1. A method for providing a cushion in condition for storage, the method comprising:

inserting a foam core into a plastic cover;

subsequent to the insertion of the foam core into the plastic cover, applying a vacuum to the plastic cover; and while the plastic cover is under the vacuum effect, sealing the plastic cover, and its contents;

wherein:

the cushion includes the foam core and a fabric cover;

the foam core is of at least 20 density high resiliency; and at least one side of the fabric cover includes a slip resistant vinyl material, which at least one of (a) includes holes plugged by a waterproof material and (b) overlays a waterproof material.

2. The method of claim 1, further comprising:

inserting the foam core into the fabric cover prior to the insertion of the foam core into the plastic cover, the step of inserting the foam core into the plastic cover including inserting the foam core with its fabric cover into the plastic cover.

3. The method of claim 2, further comprising:

at least one of folding and rolling the sealed plastic covered, fabric covered, foam core into a small footprint object having a shape.

4. The method of claim 3, further comprising:

at least one of (a) preserving the shape by at least one of taping and sealing the footprint object, and (b) inserting the small footprint object into an outer sleeve.

5. The method of claim 3, further comprising:

inserting the small footprint object into an outer cover that has a zipper; and constraining the small footprint object within the outer cover by zippering the zipper.

6. The method of claim 5, wherein the outer cover is formed of a non-woven material of fibers bonded together by at least one of chemical treatment, mechanical treatment, heat treatment, and solvent treatment.

7. The method of claim 3, further comprising:

applying an adhesive to the small footprint object to preserve the shape, wherein the adhesive includes non-stick tabs at an outer-exposed edge of the adhesive.

8. The method of claim 3, further comprising:

inserting the small footprint object into an outer sleeve that includes a pre-cut perforation.

9. The method of claim 2, wherein the fabric cover includes a cloth made by at least one of weaving, knitting, and felting fibers.

10. The method of claim 2, wherein the plastic cover includes a polyethylene material.

11. The method of claim 2, wherein:

the plastic cover includes four edges;

prior to the step of inserting the fabric covered foam core into the plastic cover, three of the edges are sealed and the fourth edge remains unsealed for the insertion of the fabric covered foam core into the plastic cover via the unsealed fourth edge; and the sealing step includes sealing the fourth edge.

12. The method of claim 1, wherein the foam core comprises at least one of an ethylene based foam and a urethane based foam.

13. The method of claim 1, wherein:

the cushion includes the plastic cover;

the fabric cover is housed by the plastic cover and houses the foam core;

the cushion includes an outer cover housing the plastic cover while the plastic cover houses the fabric cover and the fabric cover houses the foam core; and the foam core is compressed while maintained in the fabric and plastic covers.

14. The method of claim 1, wherein the plastic cover is initially heat sealed while housing the foam core in a compressed state, prior to insertion into an outer cover, and is unsealed while maintained in the outer cover.

15. The method of claim 1, wherein the fabric cover comprises a polyester fabric including raised anti-slip polyvinyl chloride dots, there being a polyvinyl chloride coating applied to other portions of the polyester fabric at which the dots are not positioned.

16. The method of claim 1, wherein the plastic cover is heat sealed while housing the fabric cover and foam core.

17. The method of claim 1, wherein the plastic cover is initially heat sealed while housing the foam core in a compressed state, prior to insertion into an outer cover, and unsealed while maintained in the outer cover.

18. The method of claim 1, wherein the cushion is a mattress.

19. A method for providing a cushion in condition for storage, the method comprising:

inserting a foam core into a fabric cover;

subsequently inserting the foam core with its fabric cover into a plastic cover;

subsequent to the insertion of the foam core into the plastic cover, applying a vacuum to the plastic cover;

while the plastic cover is under the vacuum effect, sealing the plastic cover, and its contents;

at least one of folding and rolling the sealed plastic covered, fabric covered, foam core into a small footprint object;

inserting the small footprint object into an outer sleeve; and subsequently puncturing holes into the plastic cover while the small footprint object is contained in the outer sleeve.

20. The method of claim 19, wherein applying the vacuum includes compressing the combination of the foam core, fabric cover, and plastic cover.

21. The method of claim 20, wherein a top side of the combination and an opposite bottom side of the combination are pressed towards each other by the compressing step.

22. The method of claim 21, wherein, during the compressing step, the bottom side remains stationary while the top side is pressed towards the bottom side.

23. The method of claim 22, wherein the compression is performed by a movable surface of a compression machine pressing down on the top side.

24. The method of claim 23, wherein the movement of the movable surface is implemented at least one of mechanically, hydraulically, and electrically.

25. The method of claim 22, wherein at least one edge of the movable surface includes at least a part of a heat sealing apparatus via which the sealing step is performed.

26. The method of claim 21, wherein the compressing step includes applying a compressive force of approximately 2,624,790 Pa to the combination, and the foam core comprises an at least 20 density high resiliency foam.

27. The method of claim 19, wherein:

the foam core is of at least 20 density high resiliency; and the fabric cover comprises at least one of:

(a) a combination of polyester and at least one of spandex and lycra;

(b) nylon to which a thin water resistant material coating is applied; and (c) a polyester fabric including raised anti-slip polyvinyl chloride dots, other portions of the polyester fabric at which the dots are not positioned having applied thereto a polyvinyl chloride coating.

28. The method of claim 27, wherein the fabric cover comprises the nylon to which the coating is applied, the coating including a polyvinyl chloride material.

29. The method of claim 19, wherein the plastic cover is heat sealed while housing the fabric cover and foam core.

30. The method of claim 19, wherein the cushion is a mattress.

31. A method for providing a cushion in condition for storage, the method comprising:

inserting a foam core into a fabric cover;

subsequently inserting the foam core with its fabric cover into a plastic cover;

subsequent to the insertion of the foam core into the plastic cover, applying a vacuum to the plastic cover, wherein:

applying the vacuum includes compressing the combination of the foam core, fabric cover, and plastic cover; and in the compressing step, at least one outer edge of the foam core is compressed to a lesser degree than at least one inner portion of the foam core; and while the plastic cover is under the vacuum effect, sealing the plastic cover, and its contents.

32. The method of claim 31, wherein a compressing apparatus presses against the foam core for performing the compressing, the compressing apparatus including a block that includes a thin portion by which the at least one outer edge is compressed, a thick portion by which the at least one inner portion of the foam core is compressed, and a tapered portion by which the thick and thin portions are connected.

33. A method for providing a cushion in condition for storage, the method comprising:

inserting a foam core into a fabric cover;

subsequently inserting the foam core with its fabric cover into a plastic cover;

subsequent to the insertion of the foam core into the plastic cover, applying a vacuum to the plastic cover, wherein:

applying the vacuum includes compressing the combination of the foam core, fabric cover, and plastic cover; and in the compressing step, at least one outer edge of the foam core and a center of the foam core are compressed to a lesser degree than at least one inner portion of the foam core that lies between the center and the at least one outer edge; and while the plastic cover is under the vacuum effect, sealing the plastic cover, and its contents.

34. A method for providing a cushion in condition for storage, the method comprising:

inserting a foam core into a plastic cover;

subsequent to the insertion of the foam core into the plastic cover, applying a vacuum to the plastic cover; and while the plastic cover is under the vacuum effect, sealing the plastic cover, and its contents;

wherein:

the cushion includes the foam core and a fabric cover;

the foam core is of at least 20 density high resiliency;

the fabric cover comprises at least one of:

(i) a combination of polyester and at least one of spandex and lycra;

(ii) nylon to which a thin water resistant material coating is applied; and (iii) a polyester fabric including raised anti-slip polyvinyl chloride dots, there being a polyvinyl chloride coating applied to other portions of the polyester fabric at which the dots are not positioned;

at least one side of the fabric cover includes a slip resistant vinyl material; and at least one of (a) the slip resistant vinyl material includes holes plugged by a waterproof material and (b) the slip resistant vinyl material overlays a waterproof material.

35. A method for providing a cushion in condition for storage, the method comprising:

inserting a foam core into a plastic cover;

subsequent to the insertion of the foam core into the plastic cover, applying a vacuum to the plastic cover;

while the plastic cover is under the vacuum effect, sealing the plastic cover, and its contents; and compressing the cushion with a compressing device, the compressing device comprising two surfaces configured for relative movement towards and away from each other, wherein at least one of the surfaces includes at least one protruding section and at least one non-protruding section, each of the at least one protruding section being connected to at least one respective one of the at least one non-protruding section by a respective tapered section.

36. The method of claim 35, wherein at least one edge of at least one of the surfaces includes at least a part of a heat sealing apparatus.

* * * * *